US011382837B2

(12) United States Patent
Berlin

(10) Patent No.: US 11,382,837 B2
(45) Date of Patent: Jul. 12, 2022

(54) MEDICINAL DOSAGE DEVICE

(71) Applicant: Children's Hospital Medical Center of Akron, Akron, OH (US)

(72) Inventor: Jeffrey M. Berlin, Beachwood, OH (US)

(73) Assignee: Children's Hospital Medical Center of Akron, Akron, OH (US)

( * ) Notice: Subject to any disclaimer, the term of this patent is extended or adjusted under 35 U.S.C. 154(b) by 0 days.

(21) Appl. No.: 17/103,130

(22) Filed: Nov. 24, 2020

(65) Prior Publication Data

US 2021/0154102 A1 May 27, 2021

Related U.S. Application Data

(60) Provisional application No. 62/940,546, filed on Nov. 26, 2019.

(51) Int. Cl.
*G08B 1/00* (2006.01)
*A61J 7/04* (2006.01)

(52) U.S. Cl.
CPC ..... *A61J 7/0454* (2015.05); *A61J 7/0481* (2013.01); *A61J 2200/70* (2013.01)

(58) Field of Classification Search
CPC ..... A61J 7/0454; A61J 7/0481; A61J 2200/70
USPC ..... 340/309.16
See application file for complete search history.

(56) References Cited

U.S. PATENT DOCUMENTS 1,370,956 A * 3/1921 Fish ..... A61J 7/04 116/308
1,421,219 A 6/1922 Harmon
1,796,398 A 3/1931 Richardson
1,946,385 A 2/1934 Bryant
2,625,131 A 1/1953 Sturhahn
5,271,353 A 12/1993 Besthorne
5,720,392 A * 2/1998 Price ..... G09F 11/23 215/230
7,314,022 B2 * 1/2008 Sollaccio ..... G09F 11/23 116/308
8,281,733 B2 * 10/2012 Kreshek ..... G09F 11/23 116/311
8,763,553 B1 * 7/2014 Shannehan ..... A61J 7/04 116/308
9,406,243 B2 * 8/2016 Knoff ..... A61B 5/4824

FOREIGN PATENT DOCUMENTS

GB 1121018 A 7/1968

OTHER PUBLICATIONS

Dr. Wendy Sue Swanson, "Alternating Acetaminophen and Ibuprofen for Fever," Oct. 18, 2017, 5 pages, Retrieved from the Internet on Feb. 28, 2022 <https://www.wendysueswanson.com/alternating-acetaminophen-and-ibuprofen-for-fever/.>.

* cited by examiner

*Primary Examiner* — Tai T Nguyen
(74) *Attorney, Agent, or Firm* — Tucker Ellis LLP; Heather M. Barnes

(57) ABSTRACT

A medicinal dosage device may comprise a base having dosing indicators operably connected to the base. The dosing indicators may comprise about four arms spaced at about ninety degree intervals, which may indicate a three hour block of time. The dosing indicators may be selectably movable as a unit relative to the base to indicate medicinal dosage times for at least two different medications.

20 Claims, 1 Drawing Sheet

MEDICINAL DOSAGE DEVICE

This application claims priority to provisional application having Ser. No. 62/940,546, which was filed on Nov. 26, 2019, all of which is incorporated herein by reference.

BACKGROUND

Non-opiate analgesic medications are a mainstay of pain management therapy, and utilization of drug combinations is a common practice. One of the most common drug combinations used for pain management in the pediatric and adult populations may comprise acetaminophen (Tylenol) and ibuprofen (Motrin). These drugs are often prescribed to be administered every six hours, alternating with one another by a three hour offset.

While very effective for pain management, this dosing schedule may present patients and caregivers with potential pitfalls. Firstly, giving medications every three hours in alternating sequence can be overwhelming and difficult to track. Further, if there are errors made in the alternating sequence of medications, there is potential for adverse effects.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation a medicinal dosage device may comprise a base having dosing indicators operably connected to the base. The dosing indicators may comprise about four arms spaced at about ninety degree intervals, which may indicate a three hour block of time. The dosing indicators may be selectably movable relative to the base to indicate medicinal dosage times.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
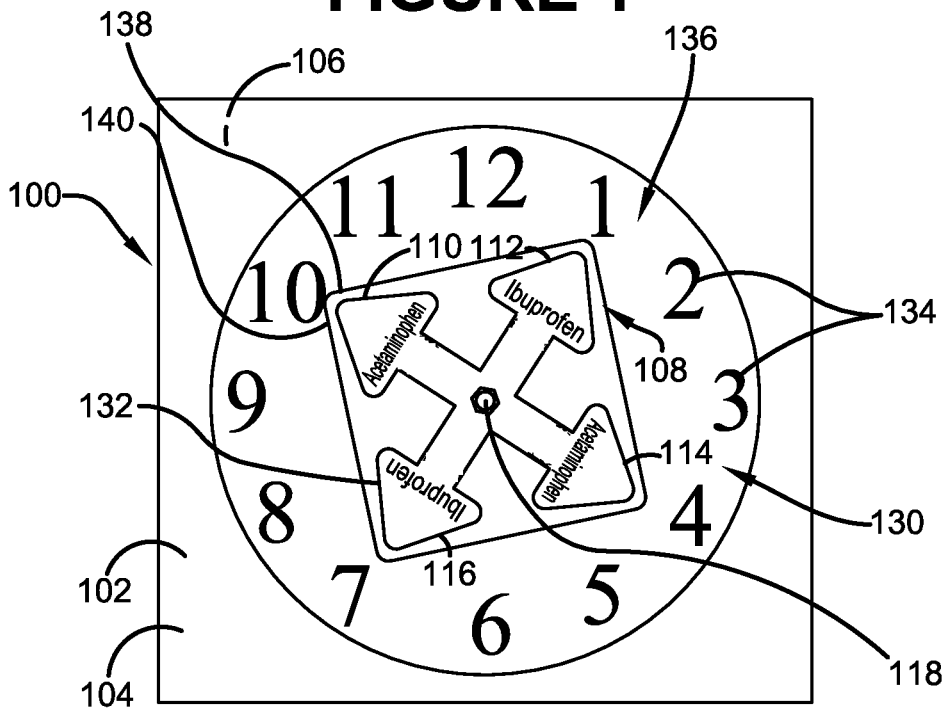
FIG. 1 is a top plan view of one implementation.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Figure 2:
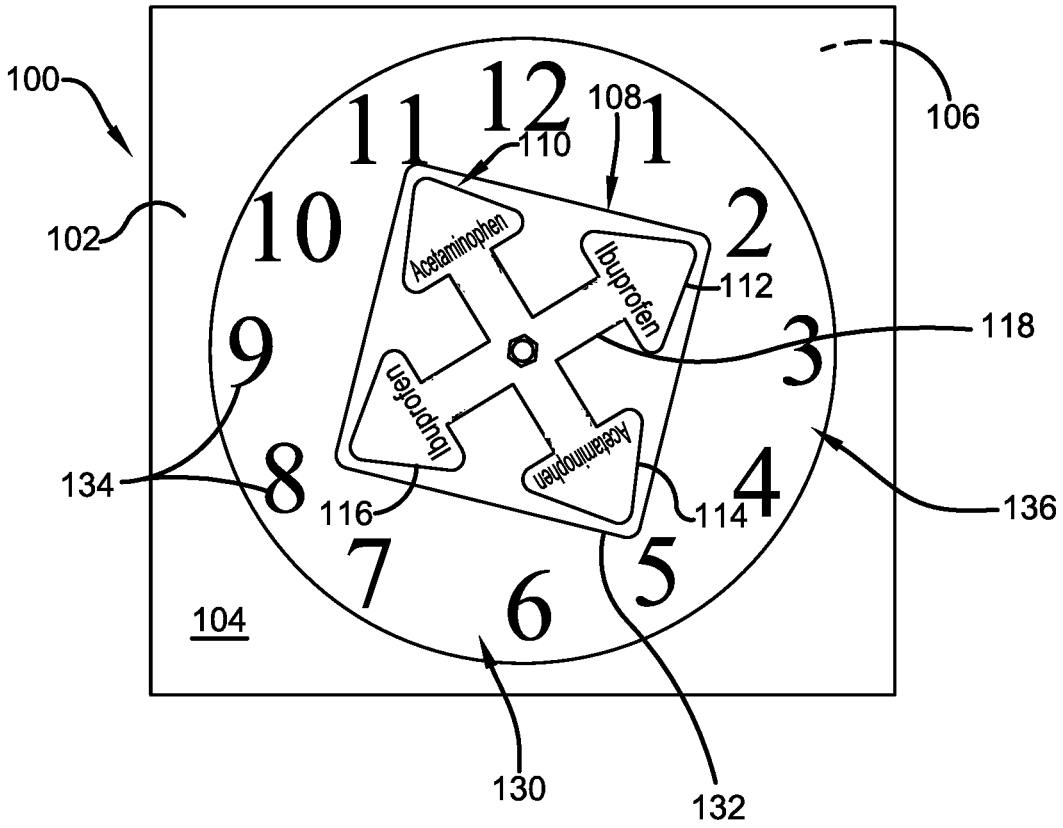
FIG. 2 is a top plan view of FIG. 1 with the dosing indicators in a different position.

FIGS. 1 and 2 illustrate a nonlimiting implementation for a medicinal dosage device 100. In one implementation a medicinal dosage device 100 may comprise a base 102. The base 102 may comprise a first surface 104 and a second surface 106 oppositely disposed from the first surface 104. The base 102 may further comprise dosing indicators 108 operably connected to the base 102. The dosing indicators 108 may be frictionally connected to the base 102. The dosing indicators 108 may also be selectably connected to the base 102. A fastener 118 may be utilized to operably connect the dosing indicators 108 to the base 102. Nonlimiting examples of fasteners 118 may include without limitation, a split pin, rivets, brads, paper rivets, grommets, or any other fastener chosen with sound engineering judgment. In one implementation, the dosing indicators 108 may take the shape of arrows, clock hands, arms, or other shape chosen in accordance with sound engineering judgment.

With reference to the FIGURES, the first surface 104 may comprise indicia 130. One nonlimiting example of indicia 130 may be letters 132 and/or numbers 134 that may comprise time indicia, such as a clock face 136. In another example, the indicia 130 may comprise pictorial representations or words of the medications being dosed at the predetermined time intervals. In yet another example, the indicia 130 may comprise labels, which may indicate the medication name and/or the medicinal dosage amount. The indicia may also be time indicia in another nonlimiting example. In yet another example, the clock face 136 may have a starting position 138 and an ending position 140. The ending position 140 may be proximate to the starting position 138. The time span between the starting position 138 and the ending position 140 may be any time span chosen with sound engineering judgment, such as twelve hours, but is not limited thereto. It is also contemplated to be within the scope of the invention that indicia 130 may be disposed on the dosing indicators 108.

The dosing indicators 108 may comprise a plurality of arms. In one implementation, the dosing indicators 108 may comprise at least four arms, including without limitation a first arm 110, a second arm 112, a third arm 114, and a fourth arm 116. The first arm 110, the second arm 112, the third arm 114, and the fourth arm 116 may move together as a unit relative to the base 102. The four arms 110, 112, 114, 116 may be spaced at about ninety degree intervals. In one implementation, the dosing indicators 108 may be movable as a unit relative to the base 102 so as to maintain a fixed special relationship of about ninety degree intervals between each dosing indicator 108. In one implementation, each ninety degree interval may represent a predetermined amount of time. For example, each ninety degree interval may represent about three hours. The dosing indicators 108 may be selectably movable relative to the base 102 to indicate medicinal dosage times. The medicinal dosage times may be for at least two different medications, which may be acetaminophen and ibuprofen for example. In one implementation, the first arm 110 and the third arm 114 may comprise times to take the first medication and the second arm 112 and the fourth arm 116 comprise times to take the second medication. By way of nonlimiting example, a dosing schedule may be scheduled as follows: acetaminophen at 12:00; ibuprofen at 3:00; acetaminophen at 6:00; ibuprofen at 9:00 etc. In such an example acetaminophen may be represented by the first arm 110 and the third arm 114. The ibuprofen may be represented by the second arm 112 and the fourth arm 116. As shown in the FIGURES, the time span shown between the first arm 110, the second arm 112, the third arm 114, and the fourth arm 114 may represent twelve hours on a clock face.

This overlapping schedule allows for maximization of pharmacokinetic effectiveness by maintaining more stable blood levels of the analgesic combination, and thereby avoiding periods of high and low blood concentrations, which may occur when the drug administrations are not offset.

This device may serve as a novel mechanism for management of dosing schedules of acetaminophen and ibuprofen for maximally effective and safer analgesia. Attempts have been made to manage this dosing schedule for patients and care takers, usually in the form of a log. While a log is effective for keeping a history of drugs given, it does not give the user an adjustable plan to follow for future doses.

The dosing indicators 108 may take the form of arrows of the clock that may be fixed at three hour intervals and may be labelled or otherwise indicate in an alternating fashion with "ibuprofen" and "acetaminophen." In one implementation, the dosing indicators 108 may distinguish the representation of different medications in any way chosen with sound engineering judgment, including without limitation, by color, shape, size or image. When rotated, the arrows and their labels maintain fixed intervals. There is enough friction in the mechanism that the arrows may not move unintentionally. The clock is to be set with an appropriately labelled arrow pointing to the time of the first dose given or to be given. The user then simply administers medications at the appropriate times based on the predetermined settings of the subsequent arrows. This will maintain that ibuprofen and acetaminophen will be given in an alternating fashion every three hours, as described above.

FIG. 1 illustrates one nonlimiting implementation where the first dose to be given is ibuprofen at 1:00. The arrows can be adjusted for changes in dosing times. If a dose is given an hour late, the arrows can be advanced one hour, for example as indicated in FIG. 2, to maintain safe and effective dosing because the hands are maintained in fixed intervals and labels relative to one another. For example, in the case above, if the first dose of acetaminophen is given an hour late, at 5:00, the arrows can be rotated as shown in FIG. 2, and the subsequent doses can be administered according to the arrows.

In other implementations, the medicinal dosage device 100 may be utilized to remind the user about timing of doses of other pairs of medications that need to be alternated every three hours. Use of other text labels or translations thereof, and/or pictures/graphics to describe the correct medication(s) and dosage(s) may also be part of an example implementation. In other example implementations, the medicinal dosage device 100 may use different shapes, sizes, colors, border material, and other features of the dosing indicators 108, such as the clock hands, to distinguish their meaning or to improve rotational function and fixation. As previously stated, the dosing indicators 108, may be any number of indicators. In other implementations, additional or fewer hands spaced at the same or different angles to indicate timing of dosages of a single medication, dual/alternating medications, or additional medications may be utilized. In another implementation, the base 102 may use a twenty-four hour clock face 136 instead of a twelve hour clock face 136. In another implementation, additional layers of independently movable/fixable hands may be utilized to indicate dosage timing of multiple medications being taken independently of one another. Additional and/or fewer hands which may be added and removed as independent units on the base and may take the form of a reversible attachment. In yet another implementation, the base may comprise the second surface 106 oppositely disposed from the first surface 104 having the indicia 130 for the medicinal dosage. The second surface 106 may comprise a space to include patient information such as height, weight etc., dosing information, drug logs, and other information.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A medicinal dosage device, comprising:

a base comprising a first surface; and dosing indicators operably connected to the first surface of the base, the dosing indicators comprising at least four arms spaced at about ninety degree intervals, each ninety degree interval being about three hours, the dosing indicators being selectably movable relative to the base to indicate medicinal dosage times for at least two different medications;

wherein the at least two different medications are ibuprofen and acetaminophen.

2. The medicinal dosage device of claim 1, wherein the dosing indicators are frictionally, selectably, and rotationally connected to the base.

3. The medicinal dosage device of claim 1, wherein the dosing indicators are movable as a unit relative to the base so as to maintain a fixed special relationship of about ninety degree intervals between each dosing indicator.

4. The medicinal dosage device of claim 1, wherein the dosing indicators comprise arrows.

5. The medicinal dosage device of claim 1, wherein the first surface comprises indicia.

6. The medicinal dosage device of claim 5, wherein the indicia comprises a clock face.

7. The medicinal dosage device of claim 6, wherein the indicia comprises numbers.

8. The medicinal dosage device of claim 6, wherein the indicia comprises pictorial representations or words of the at least two different medications.

9. The medicinal dosage device of claim 6, wherein the indicia comprises labels indicating the medication name and dosage amount.

10. The medicinal dosage device of claim 5, wherein the indicia are disposed on the dosing indicators.

11. The medicinal dosage device of claim 1, wherein the first arm and the third arm comprise times to take the first medication and the second arm and the fourth arm comprise times to take the second medication.

12. A medicinal dosage device, comprising:

a base comprising a first surface, the first surface comprising indicia;

wherein the indicia comprises time indicia, the time indicia is a clock face and has a starting position and an ending position, the ending position being proximate to the starting position, the ending position being spatially oriented about 360 degrees relative to the starting position, wherein the time span between the starting position and the ending position is twelve hours on the clock face;

wherein the indicia further comprises each of at least two different medications;

dosing indicators rotatably connected to the first surface of the base, the dosing indicators being fixed in a spatial orientation of about 90 degrees between each dosage indicator to define medicinal dosage times, wherein medicinal dosage times are for the at least two different medications.

13. The medicinal dosage device of claim 12, wherein the dosing indicators are frictionally and selectably connected to the base.

14. The medicinal dosage device of claim 12, wherein the dosing indicators comprise at least four arms, the four arms comprising a single unit rotatably connected to the base.

15. The medicinal dosage device of claim 14, wherein the at least four arms are configured to maintain the fixed spatial relationship when the at least four arms are rotated relative to base.

16. The medicinal dosage device of claim 12, wherein the two different medications are ibuprofen and acetaminophen.

17. The medicinal dosage device of claim 12, wherein the dosing indicators comprises a first arm, a second arm, a third arm, and a fourth arm, the first arm and the third arm comprise times to take the first medication and the second arm and the fourth arm comprise times to take the second medication.

18. The medicinal dosage device of claim 12, further comprising indicia including pictorial representations or words of the at least two different medications.

19. The medicinal dosage device of claim 12, further comprising indicia including labels indicating the medication name and dosage amount.

20. A medicinal dosage device, comprising:

a base comprising a first surface, the first surface comprising indicia, the indicia comprising a twelve hour clock face, each of at least two different medications, and labels indicating the medication name and dosage amount;

dosing indicators frictionally, selectably and rotatably connected to the base, the dosing indicators comprising a first arm, a second arm, a third arm, and a fourth arm, each arm spaced at about fixed ninety degree intervals, each ninety degree interval being about three hours, the dosing indicators being selectably movable as a unit relative to the base to indicate medicinal dosage times for the at least two different medications, the two different medications being ibuprofen and acetaminophen, wherein the first arm and the third arm comprise times to take the first medication and the second arm and the fourth arm comprise times to take the second medication.

* * * * *